US007900904B2

(12) United States Patent
Herrmann

(10) Patent No.: US 7,900,904 B2
(45) Date of Patent: Mar. 8, 2011

(54) MODULAR FINISHING ASSEMBLY WITH FUNCTION SEPARATION

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 404 days.

(21) Appl. No.: 11/796,878

(22) Filed: Apr. 30, 2007

(65) Prior Publication Data

US 2008/0265483 A1 Oct. 30, 2008

(51) Int. Cl.

| | |
|---|---|
| ***B42B 2/00*** | (2006.01) |
| ***B42B 2/02*** | (2006.01) |
| ***B65H 5/30*** | (2006.01) |
| ***B65H 39/00*** | (2006.01) |
| ***B65H 41/00*** | (2006.01) |
| ***B65H 39/02*** | (2006.01) |

(52) U.S. Cl. ..... 270/58.07; 270/58.08; 270/58.01; 270/52.18; 270/52.16; 270/52.14; 270/58.29

(58) Field of Classification Search ..... 270/52.14, 270/52.16, 52.18, 58.01, 58.07, 58.08, 58.29
See application file for complete search history.

(56) References Cited

U.S. PATENT DOCUMENTS

| | | | | |
|---|---|---|---|---|
| 4,017,066 | A | 4/1977 | Lasher et al. | |
| 4,462,199 | A | 7/1984 | Polit | |
| 4,589,645 | A | 5/1986 | Tracy | |
| 4,637,598 | A | 1/1987 | Bouwens et al. | |
| 4,934,683 | A | 6/1990 | Ueda et al. | |
| 5,011,123 | A * | 4/1991 | Vigano' | 270/52.04 |
| 5,026,034 | A | 6/1991 | Russel et al. | |
| 5,088,714 | A | 2/1992 | Nagasawa et al. | |
| 5,213,317 | A * | 5/1993 | Mandel et al. | 270/58.11 |
| 5,649,695 | A | 7/1997 | Lawrence | |
| 5,915,688 | A | 6/1999 | Klenk et al. | |
| 6,237,746 | B1 * | 5/2001 | Sussmeier | 198/732 |
| 6,702,278 | B1 | 3/2004 | Michel | |
| 6,755,411 | B2 | 6/2004 | Janatka et al. | |
| 6,776,412 | B2 * | 8/2004 | DaCunha et al. | 271/274 |
| 6,819,906 | B1 | 11/2004 | Herrmann et al. | |
| 6,908,079 | B2 * | 6/2005 | Milillo et al. | 270/58.08 |
| 6,973,286 | B2 * | 12/2005 | Mandel et al. | 399/391 |
| 7,021,617 | B2 * | 4/2006 | Herrmann et al. | 270/58.11 |
| 7,080,830 | B2 * | 7/2006 | Suzuki et al. | 270/58.08 |
| 7,097,028 | B2 * | 8/2006 | Henry et al. | 198/733 |
| 7,175,173 | B2 * | 2/2007 | Anzai et al. | 270/58.09 |
| 7,188,459 | B2 | 3/2007 | Brauneis et al. | |
| 7,293,766 | B2 * | 11/2007 | Ruthenberg et al. | 270/37 |

(Continued)

OTHER PUBLICATIONS http://www.xerox.com/digital-printing/printers/print-on-demand/Xerox-Nuvera-100-digital . . . .

(Continued)

*Primary Examiner* — Gene Crawford
*Assistant Examiner* — Yolanda Cumbess
(74) *Attorney, Agent, or Firm* — Fay Sharpe LLP

(57) ABSTRACT

A finishing assembly suited to use in a printing system includes a plurality of finishing modules, each of which performs a finishing function. The plurality of finishing modules includes a compiler module which compiles sheets into a set of sheets and at least one stacker module, downstream of the compiler module, which is configured for receiving compiled sets of sheets compiled by the compiler module and stacking a plurality of the sets of sheets into a stack. Optionally, at least one sheet processing module is intermediate the compiler module and the stacker module and receives a compiled set of sheets compiled by the compiler module and processes the compiled set of sheets.

12 Claims, 4 Drawing Sheets

U.S. PATENT DOCUMENTS

| | | | | |
|---|---|---|---|---|
| 7,354,037 | B2 * | 4/2008 | Olson et al. | 270/58.14 |
| 2003/0168796 | A1 * | 9/2003 | Suzuki et al. | 270/58.07 |
| 2004/0253033 | A1 | 12/2004 | Lofthus et al. | |
| 2005/0206065 | A1 | 9/2005 | Herrmann et al. | |
| 2006/0176336 | A1 | 8/2006 | Moore et al. | |
| 2006/0244202 | A1 | 11/2006 | Herrmann et al. | |

OTHER PUBLICATIONS http://www.brecoflex.com.

* cited by examiner

MODULAR FINISHING ASSEMBLY WITH FUNCTION SEPARATION

BACKGROUND

The exemplary embodiment relates generally to the sheet processing arts. It finds particular application in connection with a modular finishing assembly in which various finishing functions are separated among the modules.

High speed reprographic devices, such as printers, copiers, and multifunction (print/copy/fax) machines are being formed with increasingly higher output speeds to meet customer demands. In the image rendering process, pages of a multi-page document are formed by printing images on sheets of paper, or other print media substrate, using colorants, such as inks or toners. The printed pages are conveyed singly to a finisher, which outputs the finished document. The finisher may incorporate several different functions, such as folding, stapling, collating, binding, and the like. Typically, the finisher must compile, register, staple and drop a set of pages prior to the next set being loaded. Each of these steps takes a certain amount of time and thus the throughput of the printing system may be limited by the capabilities of the finisher. Any increase in throughput generally requires a direct decrease in function timing and a corresponding increase in velocity. This requires each function to operate at high speed, which may put a strain on the paper handling, the mechanics and overall reliability and function of the finisher. While increases in speed may be achieved by distributing print jobs among plural finishers, this adds to the cost of the printing system.

INCORPORATION BY REFERENCE

The following references, the disclosures of which are incorporated herein in their entireties by reference, are mentioned:

The following references relate generally to systems and methods for compiling and transferring substrates, such as sheets of paper: U.S. Pat. Nos. 4,017,066; 4,589,645; 4,637,598; 4,934,683; 5,026,034; 5,088,714; U.S. Pat. No. 5,915,688; and U.S. Pat. No. 5,649,695.

U.S. Pub. No. 20060244202, published Nov. 2, 2006, entitled PRINTED SHEETS STACKING TRAY WITH AUTOMATIC ALTERNATE STACKING SUPPORT AND MANUAL STACK LIFTING ASSISTANCE, by Douglas K. Herrmann, et al. discloses a sheet stacking and unloading system in which sheets are stacked on a stacking tray which is then moved from its sheet stacking position to an unloading position for removing the sheet stack from the stacking tray, and the stacking tray has a sheet stacking surface partially interrupted by at least one handhold area for allowing manual lifting access underneath a portion of a stack, there is automatically inserted into the handhold area at least one supplemental sheet stack supporting member to provide supplemental sheet stacking support, preventing the sheets from sagging in those areas, which supplemental sheet stack supporting member is automatically removed from the handhold area when the stacking tray is moved to its unloading position.

U.S. Pat. No. 7,021,617, issued Apr. 4, 2006, entitled CLAMP ACTUATOR SYSTEM AND METHOD OF USE, by Douglas K. Herrmann, et al. discloses a substrate compiling system which includes an actuator, cable and tamper device. The tamper device includes a clamp assembly. The clamp assembly is retracted and extended. The clamp assembly can be used to clamp an edge of each compiled set of substrates and transfer the compiled set to a stacking tray, platform or the like. The clamp assembly may remain in an extended position until all other substrate supporting structures no longer support the substrates and an opposing unclamped edge of the compiled set engages the stacking tray below.

U.S. Pub. No. 20040253033, published Dec. 16, 2004, entitled UNIVERSAL FLEXIBLE PLURAL PRINTER TO PLURAL FINISHER SHEET INTEGRATION SYSTEM, by Lofthus, et al., discloses a multifunction printed sheets interface system with sheet input areas for receiving printed sheets and output areas for outputs to different sheet processing systems. A sheet transporting system provides selectable sheet translation from selected plural sheet input areas to selected plural sheet output areas so as to provide selectable sheet feeding from selected printers to selected sheet processing systems, and selectable sheet rotation of selected sheets and selectable sheet merging in a selected sheet sequence of sheets from plural printers.

U.S. Pat. No. 6,973,286, issued Dec. 6, 2005, entitled, HIGH PRINT RATE MERGING AND FINISHING ASSEMBLY FOR PARALLEL PRINTING by Barry P. Mandel, et al. discloses a system for printing media which includes a plurality of marking engines for outputting printed media in a stream, a media path system operable to transport the printed media from the marking engines to one or more finishing stations such that the streams are merged and transported one on top of the other and one or more finishing stations capable of compiling media in groups of 2 or more sheets for post processing the printed media into one or more completed jobs.

U.S. Pub. No. 20060176336, published Aug. 10, 2006, entitled Printing systems, by Steven R. Moore, et al. discloses a printing system which includes first and second output modules which receive print media from first and second marking modules. The first and second output modules each include a finisher. The first and second output modules each include a portion of a print media network.

BRIEF DESCRIPTION

In accordance with one aspect of the exemplary embodiment, a finishing assembly includes a plurality of finishing modules, each of which performs a finishing function. The plurality of finishing modules includes a compiler module which compiles sheets into a set of sheets and at least one stacker module, downstream of the compiler module, which is configured for receiving compiled sets of sheets compiled by the compiler module and stacking a plurality of the sets of sheets into a stack. Optionally, at least one sheet processing module is intermediate the compiler module and the stacker module and receives a compiled set of sheets compiled by the compiler module and processes the compiled set of sheets.

In accordance with another aspect of the exemplary embodiment, a method of finishing previously marked sheets includes performing a first finishing operation on a first set of sheets in a first finishing module and performing a second finishing operation on a second set of sheets in a second finishing module contemporaneously with the first finishing operation. Thereafter, the first set of sheets is advanced from the first finishing module to a first downstream finishing module. Contemporaneously with advancing the first set of sheets, the second set of sheets is advanced from the second finishing module to a second downstream finishing module.

In accordance with another aspect, a printer includes a marking engine which marks sheets of print media. A finishing assembly receives marked print media from the marking engine and sequentially applies at least first and second post-marking finishing operations thereto. The first and second finishing operations are performed contemporaneously on respective sets of the marked sheets whereby a first of the sheet sets is undergoing a first finishing operation while a second set of the marked sheets is undergoing a second finishing operation and in which the first set of marked sheets which has undergone the first finishing operation is advanced in a horizontal direction contemporaneously with the advancement of a second set of marked sheets which has undergone the second finishing operation.

DETAILED DESCRIPTION

In various aspects of the exemplary embodiment disclosed herein, a finishing assembly includes a plurality of finishing modules, each of the modules assuming a different function of a finishing operation. By separating the functions, the finishing assembly can act as a production line. Through breaking down the entire process into parts, each piece can be performed at a set rate. A product is then produced at what is referred to in manufacturing as a takt time. Once the queue is filled, the finishing assembly can produce a set in a short period of time, which is substantially a function of the longest step in the process. Since each job, such as compiling, registration, stapling, stacking, may be performed separately, the timing can be significantly reduced without necessarily having to speed up any of the individual processes. Moreover, with the processes separated, the finisher can now be separated into specialized units that can be mixed and matched to meet customer requirements. Each function can be assigned to a separate module.

The term "reproduction apparatus" or "printer" as used herein broadly encompasses various printers, copiers or multifunction machines or systems, xerographic or otherwise. The term "sheet" herein refers to a usually flimsy physical sheet of paper, plastic, or other suitable physical print media substrate for images. The term "sheet stacking tray" broadly encompasses various sheet stacking bins or drawers unless indicated otherwise. A "print job" or "document" is normally a set of related such sheets, usually one or more collated or other sets copied from a set of original document sheets or electronic document page images from a particular user, or for a particular customer, or otherwise related. The operation of applying images to print media, for example, graphics, text, photographs, etc., is generally referred to herein as printing or marking.

Figure 1:
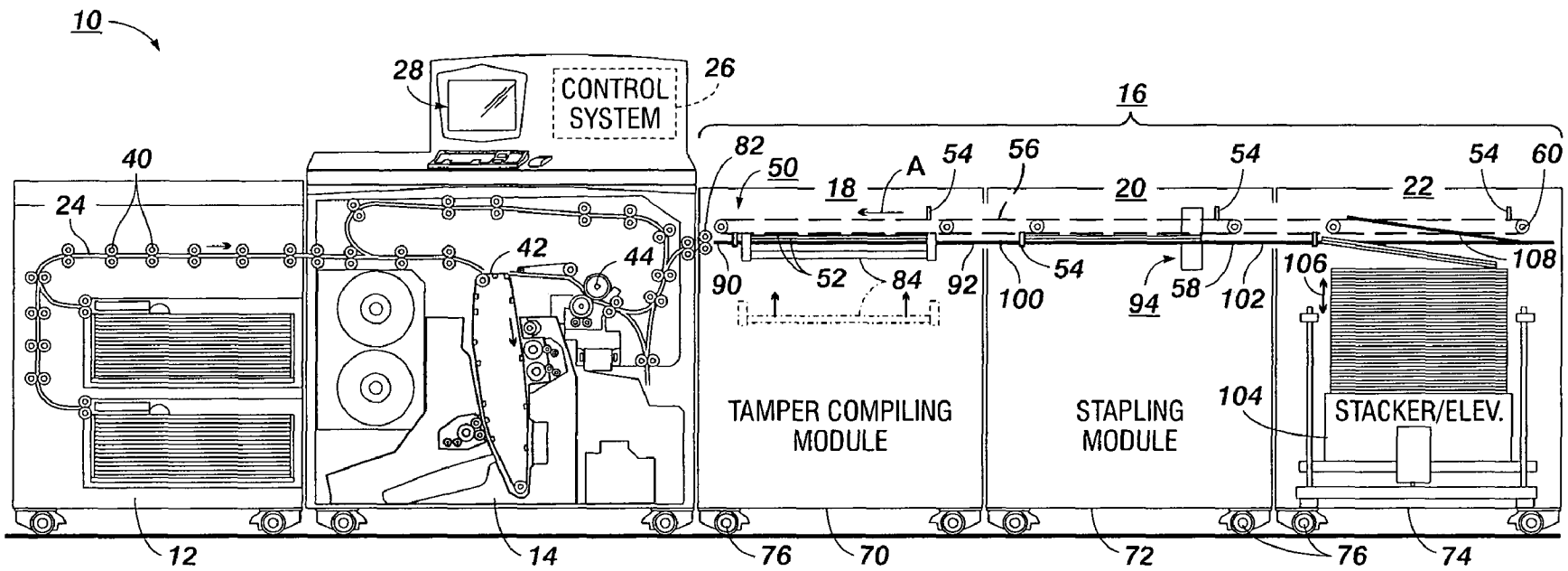
FIG. 1 is a schematic side sectional view of a xerographic printer incorporating a finishing assembly in accordance with one aspect of the exemplary embodiment.

With reference to FIG. 1, an exemplary printer 10 includes at least one feeder module 12, at least one marking engine module 14, and a finishing assembly 16, which includes a plurality of finishing modules, herein illustrated as a compiling module 18, a sheet set processing module, such as a stapling module 20, and a stacker module 22. A conveyor system 24, which provides a network of print media pathways, conveys sheets of print media from the feeder module 12 to the marking engine module 14 for printing and thereafter coveys the printed media to the finishing assembly 16 for performing various finishing operations.

The printing system 10 executes print jobs. Print job execution involves printing images, such as selected text, line graphics, photographs, magnetic ink character recognition (MICR) notation, and the like on front, back, or front and back sides or pages of one or more sheets of paper or other print media. Some sheets may be left completely blank. Some sheets may have both color and monochrome images. Execution of the print job may also involve compiling a set of the sheets in a certain order. Still further, the print job may include one or more sheet set processing operations performed on a compiled set of sheets, such as stapling, punching holes into, binding or otherwise physically manipulating a compiled set. Finally, the print job may include stacking a plurality of the compiled and processed sets to form a stack of the sets. The printing, finishing, paper handing, and other processing operations that can be executed by the printing system 10 are determined by the capabilities of the paper feeder module 12, marking engine module 14, and finisher modules 18, 20, 22 of the printing system 10. These capabilities may increase or decrease over time due to addition of new components, upgrading of existing components or removal of components. The components 12, 14, 18, 20, 22 of the printing system 10 may all be under the control of a common control system 26, resident in the printer's computer commonly referred to as the digital front end (DFE). A human operator may interact with the control system 26 through a user interface 28, here illustrated as a graphical user interface (GUI).

Figure 2:
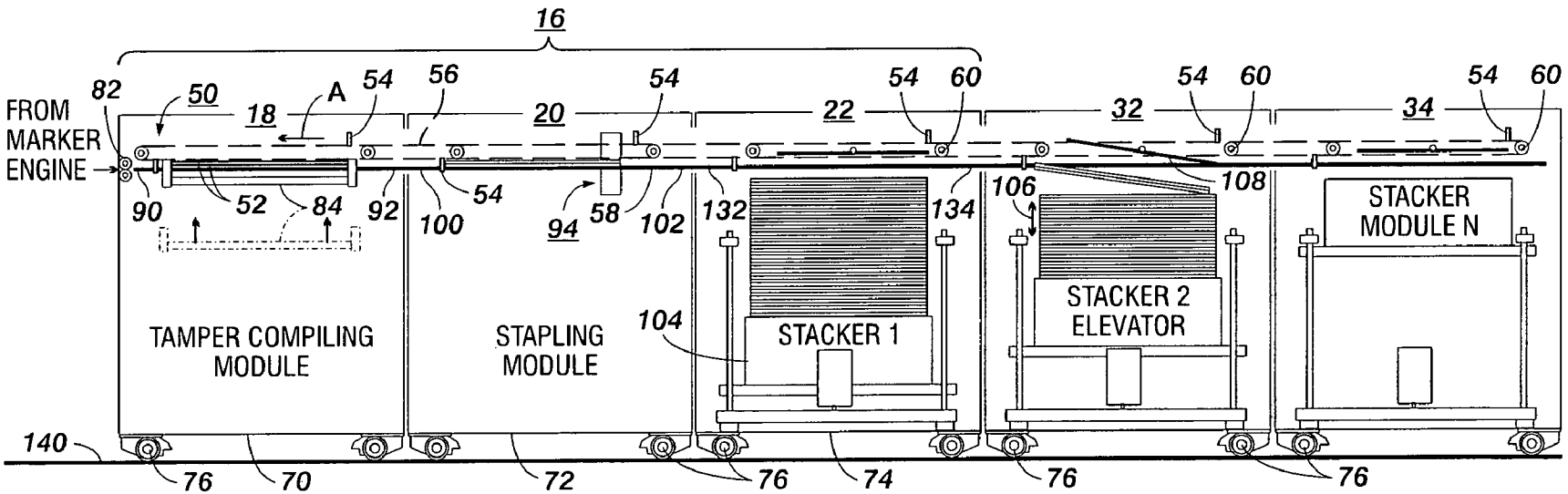
FIG. 2 is a schematic side sectional view of a finishing assembly in accordance with another aspect of the exemplary embodiment.

With reference to FIG. 2, another embodiment of a finishing assembly 30 is shown which may be employed in the printing system 10 of FIG. 1. In the embodiments of FIGS. 1 and 2, the finishing assembly 16, 30 generally operates to compile and finish printed media. The modular finishing assembly 30 is similarly configured to system 16 of FIG. 1, where similar elements are accorded the same numerals. Assembly 30 includes a compiling module 18, a stapling module 20, and three stacker modules 22, 32, 34, in place of the single stacker module 22 shown in FIG. 1. As will be appreciated, the finishing assembly 16, 30 may include any number of stacker modules, such as one, two, three, or more.

The printing system 10 shown in FIGS. 1 and 2 is illustrative. In general, any number of print media feeders, media handlers, marking engines, finisher modules or other processing units can be connected together by a suitable print media conveyor configuration. As will be appreciated, there may be additional modules interposed between the marking engine module 14 and the finishing assembly 16, 30 such as a buffer module, a merge module (for merging sheets from a second marking module), or the like.

The conveyor system 24 includes a plurality of drive members, here illustrated as rollers 40, which convey the printed sheets generally horizontally in a downstream direction, between the various components of the printer. Other drive members, such as airjet transport modules, spherical nips ("SNIPS") spin-roller drives, omni-directional drive systems, and the like may also be used.

The marking engine 14 can be any suitable device for applying images to the print media sheets. In the illustrated embodiment, the marking engine is a xerographic marking engine comprising a charge retentive surface, such as a rotating photoreceptor 42 in the form of a belt or drum. The images are created on a surface of the photoreceptor. Disposed at various points around the circumference of the photoreceptor are the xerographic subsystems, which include a cleaning device, a charging station for each of the colors to be applied (one in the case of a monochrome marking engine, four in the case of a CMYK printer), such as a charging corotron, an exposure station, which forms a latent image on the photoreceptor, such as a Raster Output Scanner (ROS) or LED bar, a developer unit, associated with each charging station for developing the latent image formed on the surface of the photoreceptor by applying a toner to obtain a toner image, a transfer unit, such as a transfer corotron, transfers the toner image thus formed to the surface of a print media substrate, such as a sheet of paper. A fuser 44 fuses the image to the sheet by applying at least one of heat and pressure to the sheet. While a xerographic marking engine is illustrated, other marking engines, such as ink-jet or solid ink marking engines are also contemplated. The finishing assembly 16, 30 thus receives marked and optionally fused sheets from the marking engine 14.

With continued reference to FIGS. 1 and 2, the modules 18, 20, 22, 32, 34, are arranged sequentially. Sheets processed by an upstream module are transferred to the next downstream module, and so forth. A sheet set advancement assembly 50 is configured for pushing sets 52 of sheets between finishing modules. The illustrated sheet set advancement assembly 50 is configured for moving sets of printed sheets between finishing modules, such as a set 52 of ten or more sheets, laid on top of each other. As will be appreciated, the number of sheets in a set will depend on the particular print job, and in some instances, a set may comprise as few as a single sheet. In general, however, sets typically comprise a plurality of sheets. The set 52 of sheets being moved may be bound or unbound.

Figure 3:
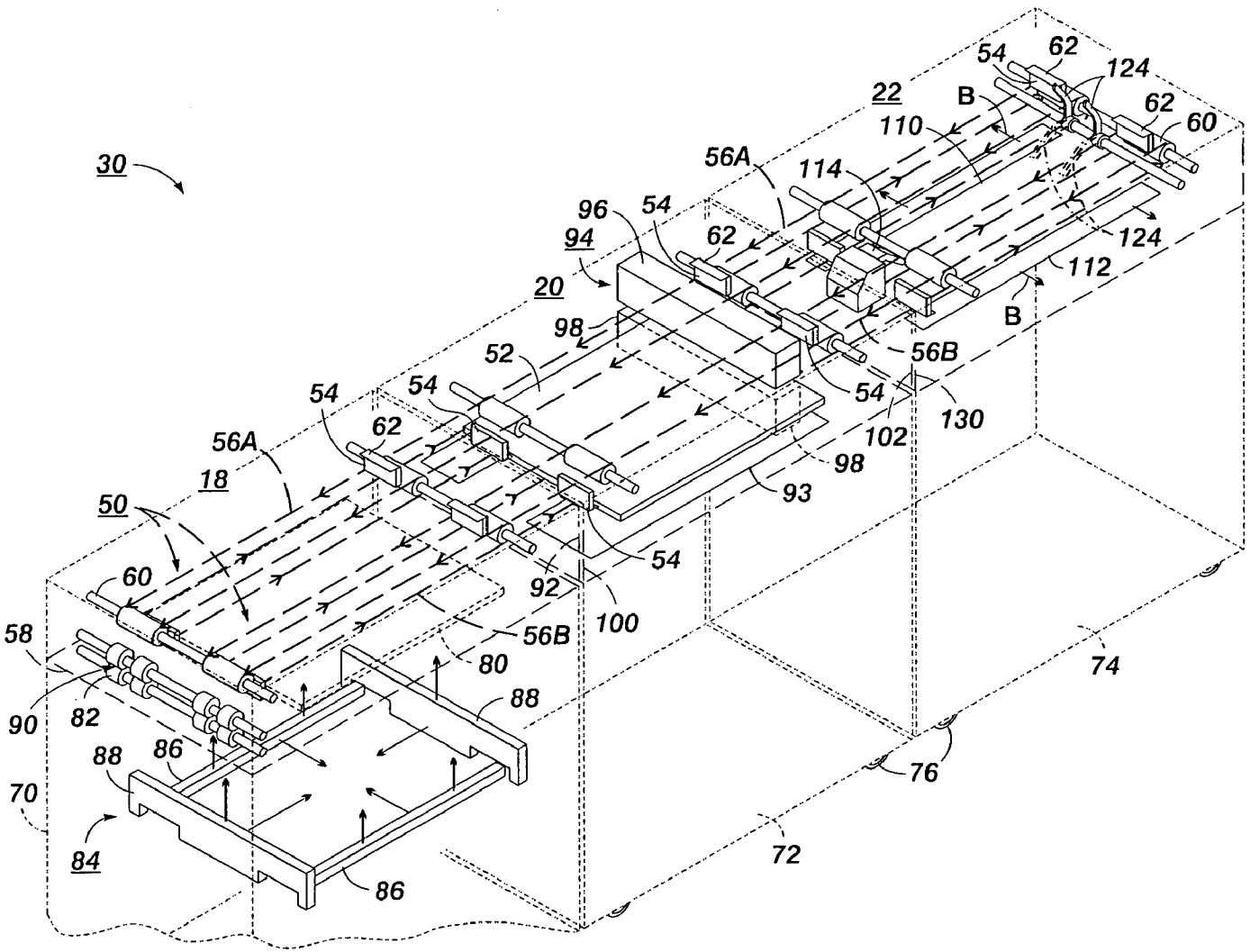
FIG. 3 is a perspective view of part of a finishing assembly in accordance with another aspect of the exemplary embodiment with a stack of sheets in a first position.

The illustrated advancement assembly 50 is positioned above the sheet sets and includes at least one and generally a plurality of pusher members 54 which are driven by a drive system, here illustrated as comprising a horizontally extending continuous timing belt 56, which travels in a loop in the direction illustrated by arrow A. The timing belt is vertically spaced from a finishing assembly paper path 58. As discussed below, the paper path 58 is defined by baffles, which support the sheets from below as the sheet sets are moved by the advancement assembly along the paper path. The sets of sheets generally slide across the baffles, while the baffles remain stationary. The sheet advancement assembly 50 may include two (or more) conveyor belts 56A and 56B, spaced apart and running in parallel, as illustrated in FIG. 3, such that pairs of pusher members 54A, 54B are arranged in tandem to push the sheet sets 52 from two spaced locations in the cross-process direction. In one embodiment, the pusher members are integrally formed with or welded on to the belt 56, and may be formed, for example, from plastic, such as a polyurethane. In other embodiments, the pusher members may be removable from the conveyor belt and may be re-positionable in different suitable positions along the belt. Suitable belts and pusher members are available from Brecoflex Co., LLC, and include ATN polyurethane timing belts with repositionable or weld-on profiles which serve as the exemplary pusher members.

As illustrated in FIG. 1, the two conveyor belts 56 are mounted on horizontally spaced rollers 60, at least one of the rollers being a driven roller. The pusher members 54 are spaced around the conveyor belt at intervals of about one module 18, 20, 22 apart. In this way, a first set of pusher members pushes a sheet set between modules 18 and 20 while, at the same time, a second set of pusher members pushes a sheet set between modules 20 and 22. The illustrated pusher members 54 are each in the form of a rigid planar member which extends vertically away from the conveyor belt 56 to engage the trailing (upstream) edges an entire set 52 of sheets and move the set as a unit. Optionally, the pusher member 54 may be L-shaped and have a small hook 62 at its distal end which slides under the trailing edge of the bottom sheet in the set to aid in guiding an unbound set of sheets (FIG. 3). The illustrated conveyor belts 56 extend from the first module 18 to the last module (module 34 in FIG. 2). However, in other embodiments, two or more conveyor belts may be arranged in sequence. For example, each module 18, 20, 22, 32, 34 may have its own conveyor belt or parallel pair of conveyor belts.

With reference to FIG. 1, the illustrated finisher modules 18, 20, 22 may be separable and interchangeable modules. In the illustrated embodiment, each module includes a housing or frame 70, 72, 74, etc which may be carried on wheels 76. The functional components of each finishing module are supported by the respective housing 70, 72, 74.

In the illustrated embodiment, module 18 is a compiling module. The compiling module includes a compilation platform 80. Platform 80 is in the form of a horizontally extending plate which defines part of the paper path 58 and serves as a stationary baffle for the module 18. The platform 80 receives sheets, generally singly, which are stacked one on top of each other as they arrive to form a set. The sheets may be released in turn from nip rollers 82 of the conveyor system 40, which are positioned slightly above the compilation platform. Once a set of the desired number of sheets has formed on the compiling platform, a tamper device 84, which may normally be a retracted position, can be raised from its retracted position to an extended position, slightly above the compilation platform 80. The tamper device compiles a set of sheets, generally by tamping them from process and cross process directions with pairs of opposed tamping members 86, 88 (FIG. 3). Once the sheets have been compiled into a set, the conveyor system advances the next pair of pusher members 54 to push the set 52 along the print media pathway to the next finishing module 20. The compiling module 18 then works on compiling the next set of sheets while the module 20 performs further finishing steps on the first set. The compiling module thus only performs a compiling function and does not perform punching, stapling, or other sheet processing functions.

Module 18 has an inlet 90 at a first, upstream end of the housing and an outlet 92 at a second, downstream end and defines a first portion of the print media path 58 therebetween.

The illustrated set processing module 20 is a stapling module, which receives a set 52 of compiled sheets from the compiling module 18. The sheets are pushed by the pushers 54 across a pair of horizontally spaced stationary baffles 93 in the form of horizontal plates. The stapling module staples the set of sheets in the set to form a stapled set of sheets. In the illustrated embodiment, the stapling module includes a stapler 94 which, when open, allows the stapled set of sheets to pass therethrough. As illustrated in FIG. 3, an upper portion 96 of the stapler may be located between the two conveyor belts 56A, 56B, so that it does not interfere with the pusher members 54A, 54B. While travelling through the stapler module, the set 52 may be supported on the pair of horizontally spaced baffle plates 93, which provide access therethrough to a lower portion 98 of the stapler. In particular, the pusher members 54 push the set 52 to a position in which the leading edge of the set can be clamped by the stapler 94 and a staple or staples applied to the set. In other embodiments, the stapler may be retracted to one side of the paper path, allowing the stapled sheet set to pass by. As will be appreciated, the stapling module 20 may include a stapler for stapling an upper edge of the sheet in addition to or as an alternative to the side edge stapler 94 illustrated.

Once the sheets have been stapled together, the advancement of the advancement system 50 advances the pusher members 54 which push the set 52 along the print media pathway 58 to the next finishing module 22. The stapling module 20 then works on stapling the next set of sheets while the module 22 performs further finishing steps on the first set. As will be appreciated, the module 20 may additionally or alternatively perform other sheet processing operations, such as binding, stitching, hole punching, or the like. The stapling module thus performs only sheet set processing functions, and does not perform a compiling or stacking function. In the event that the document is to be unbound, the set 52 of sheets proceeds through the module 20 and no stapling or other binding is performed. Alternatively, the compiled set to be left unbound may be routed around the stapling module on a bypass path (not shown).

Module 20 has an inlet 100 at a first, upstream end of the housing and an outlet 102 at a second, downstream end and defines a portion of the print media path 58 therebetween.

Module 22 is a stacking module which receives sets of compiled and optionally bound sheets from the stapling module 20. The stacking module 22 stacks multiple sets of bound or unbound sheets. The stacker module includes a stacker tray 104 which is moved vertically by an elevator mechanism (illustrated in FIG. 2 by a two-direction arrow 106) to accommodate the increasing height of a stack of sets 52 of sheets. The stacker tray can be any platform, surface, or the like capable of holding a stack of sets of compiled and optionally stapled sheets or sets of sheets. The elevator mechanism 106 may include a sensor (not shown) which, when it senses sheets or a clamp for the sheets in the path of its beam, causes the elevator mechanism to move the tray 104 progressively downward so that the stacker tray may accommodate additional sets of sheets.

Various release mechanisms for releasing the set of sheets from the paper path onto the stacker tray 104 are contemplated. In the embodiment illustrated in FIG. 2, the release mechanism includes a moveable baffle or gate 108, which is moveable between first and second positions. In the first position, shown on module 32, the baffle allows a set of sheets to drop onto the elevator. In the second position, shown on modules 22 and 34, by way of example, the baffle 108 closes off access to the stacker tray and allows sets of sheets pass through the module without stacking. The illustrated baffle 108 is a pivotable baffle which is pivoted, about a downstream end thereof, between the first and second positions.

Different stacking modules 22, 32, 34 may have their baffles 108 in different positions, depending on whether they are currently in use. Thus, in FIG. 2, the first stacking module 22 has a full stack of sheet sets and so the baffle 108 is closed until that stack has been removed from the module. Sheet sets are pushed by the pushers 54 so that they travel across the stationary, closed baffle to the next available stacker module, in this case, module 32. This stacker module receives sets of sheets until its stack is full, and so forth. The trays of other stacker modules, such as module 34, can remain empty and their baffles closed until the upstream stacker modules are full.

Figure 4:
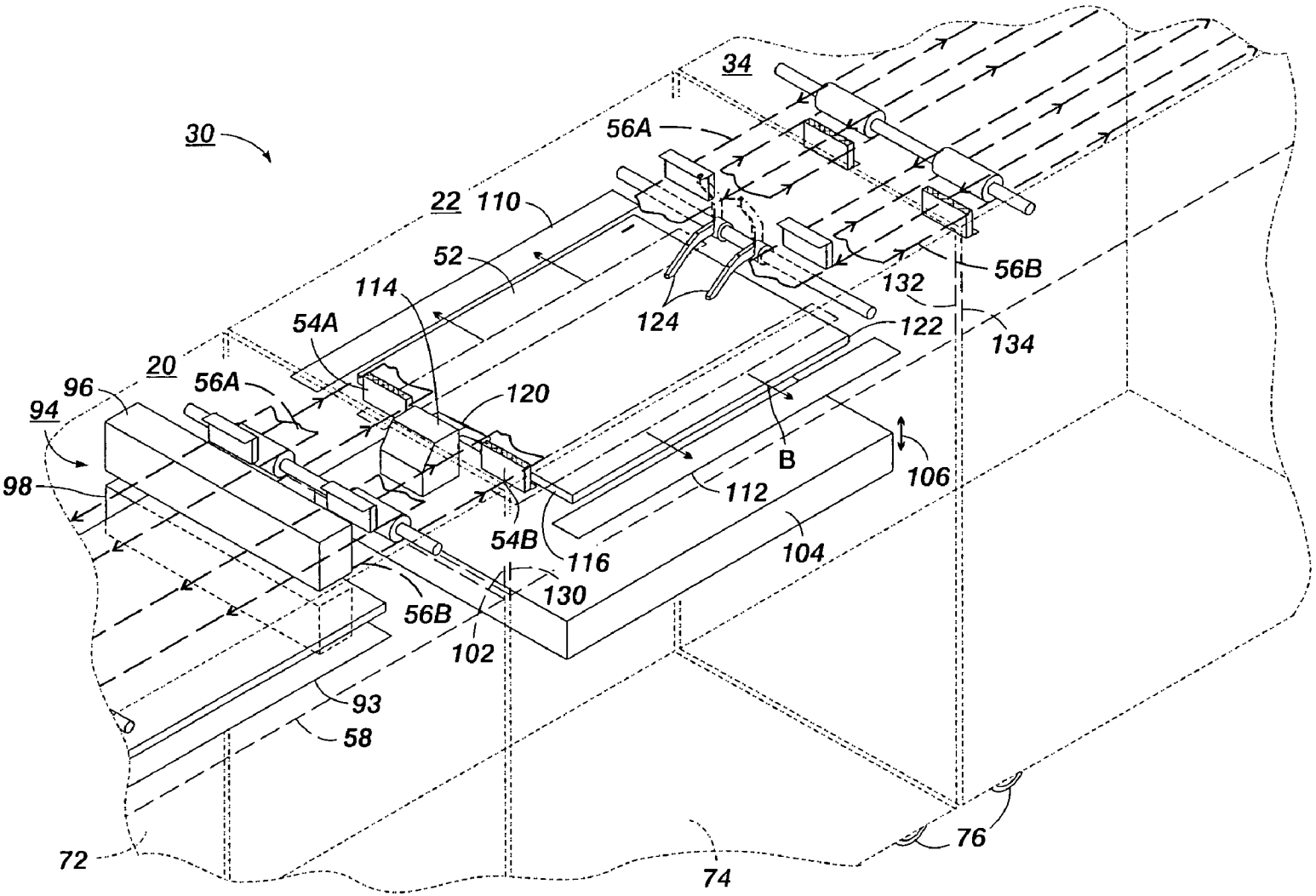
FIG. 4 is a perspective view of the finishing assembly of FIG. 3 after the stack has moved to a second position.

In the embodiment shown in FIGS. 3 and 4, an alternative release mechanism for the stacker modules comprises a pair of sliding baffles 110, 112 and a clamping mechanism 114. The sliding baffles may be in the form of plates which move horizontally apart to allow the sheet set 52 to drop between them. The plates 110, 112 may be driven by suitable drive mechanisms (not shown) in the directions illustrated by arrows B. In one embodiment, the sheet set is pushed across the baffles 110, 112 by the pushers 54 from the position shown in FIG. 3 until its trailing edge 116 is over the stacker tray, as shown in FIG. 4. At this point, the sheet set may be clamped by a trailing edge clamp 120 of clamping mechanism 114. The trailing edge clamp 120 may be positioned above the paper path 58 and lowered onto the trailing edge sheet set after the set is in position. In another embodiment, it may be raised from below, after the set has passed over it, or pivoted into a clamping position. The trailing edge clamp 120 clamps the set 52 of sheets and holds it while the baffles 110, 112 are moved to their open, second position. Shortly thereafter, as the leading edge 122 of the sheet set begins to tip downward, under its own weight, one or more sheet set separators 124 are raised to a position in which they overlie the leading edge 122 of the sheet set (FIG. 4). The trailing edge clamp 120 thereafter releases the trailing edge of the sheet set. The sets of sheets form a stack on the stacker tray 104 of the stacker module. The sheet set separators 124 clamp the top set 52 onto the stack. At this point, the elevator mechanism sensor may detect the position of leading edge clamp 124 and adjust the height of the stacker tray accordingly. The stacker tray can be any platform, surface, or the like capable of holding a set of compiled and optionally processed sheets after the compiled set is clamped and transferred. In one embodiment, the arrangement of trailing edge clamps 120 may operate analogously to the clamping mechanism described in U.S. Pat. No. 7,021,617, incorporated herein by reference. The sheet separators 124 may operate analogously to the sheet separators disclosed in U.S. Pat. No. 6,702,278, the disclosure of which is incorporated herein by reference in its entirety.

As will be appreciated, in another embodiment, the positions of the forward edge clamps and sheet set separators 120, 124 may be reversed such that the leading edge of the set is clamped while the trailing edge of the set is allowed to drop toward the stacker tray. In yet another embodiment, the baffle plates 110, 112 may be arranged in locations which are rotated 90 degrees to the positions shown and thus may open in a direction parallel to the process direction. In this embodiment, the clamps 120, 124 may be arranged to clamp the sides of the sheet set, rather than its trailing and leading edges.

As will be appreciated, each of the stacker modules in the finishing assembly may be similarly configured to stacker module 22. The stacker modules 22, 32, 34 are not limited to the designs illustrated and described herein, but may be of any suitable configuration which allows sets of sheets to be stacked or, where multiple stacker modules are provided, to pass through to a downstream stacker module.

Where multiple stacker modules are present, as shown in FIG. 2, module 22 has an inlet 130 at a first, upstream end of the housing and an outlet 132 at a second, downstream end and defines a portion of the print media path therebetween. Additional stacker modules 32, 34 may be similarly configured and thus interchangeable. Optionally, one of the stacker modules (module 22 in FIG. 1, module 34 in FIG. 2) is configured as a terminal stacker module which lacks an outlet 132 to the horizontal paper path 58 and defines a downstream end of the conveyor belt 56.

By separating finishing operations in the manner thus described, one set of sheets can be in the process of being compiled while the previous (downstream) set is being stapled and the previous set to that is being stacked. The process can be performed at a much slower and controlled velocity while the overall output of the finishing assembly 16, 30 is increased. In particular, once the print job is underway, sets move through the finishing assembly 16, 30, in a stepwise advancement at a predetermined speed, which may be determined by the time taken by the module which takes the longest time to complete is operating function(s). Each finishing module may thus be performing its operations contemporaneously on a respective set of sheets. By contemporaneously it means that the times at which these operations take place overlap, at least in part. Once the respective finishing operations are complete, the conveyor system 50 is actuated to move each upstream set contemporaneously from the module in which it is located to the next respective downstream module. Thus, at any one time, a sheet set is being advanced from the compiler module 18 to the sheet set processing module 20 (or to a first of the sheet set processing modules, if there are more than one) at the same time as another sheet set is being advanced from the sheet set processing module 20 (or from a last of the sheet set processing modules, if there are more than one) to the stacker module 22. Contemporaneously with this, if more than one stacker module is present and the upstream one is full, a sheet set may be being advanced from a first of the stacker modules to a second of the stacker modules, and so forth. As will be appreciated, there may be additional modules, such as buffer modules, in between pairs of modules 18, 20, 22, 32, 34. The inlets and outlets 92, 100, 102, 130, 132 of all the modules may be arranged at the same height above a support surface 140, such as the floor, whereby the paper path 58 is substantially horizontal.

In general, the compiler module 18 is typically the module which takes the longest to perform its function, since sheets typically arrive singly and sequentially at the compiler module. In one embodiment, the control system 26 determines the time taken for the compiler module 18 to complete the compiling step, e.g., based on the number of sheets to be compiled in the set, and adjusts the time between actuations of the pusher members 54 in accordance therewith, i.e., allows a longer time between actuations for a larger set of sheets.

While the exemplary finisher modules are illustrated in terms of a compiler module, a stapler module, and one or more stacker modules, one or more of the finisher modules can be any post-printing accessory device, such as a sorter, mailbox, folder, hole puncher, collater, stitcher, binder, envelope stuffer, postage machine, or the like. Exemplary envelope stuffers, also known as envelope inserters or fillers, are described in U.S. Pat. Nos. 4,462,199, 6,755,411, and 7,188,459, the disclosures of which are incorporated herein by reference). Each unit may have a bypass to further speed the system and improve modularity. Additional functions can then be added as new products are created.

While the illustrated finishing assembly 16, 30 is shown as a linear system, in other embodiments, modules may be stacked vertically, and or in parallel. In one embodiment, one or more of the modules has a outlet which is arranged generally at right angles to its inlet or an additional module may be added in between two of the illustrated modules which provides for redirection and optionally rotation of the print media sets. In this way, a right angle transfer may be provided in line to change from short edge feed to long edge feed which would shorten the pitch and allow for differing configurations.

The finishing assembly 16, 30 and other components of the printer 10, operate under the control of control system 26 in accordance with a program stored in a memory (not shown) and/or in response to feedback from any desired or necessary sensors (not shown), as will be appreciated by those skilled in the art. The memory can be implemented using any appropriate combination of alterable, volatile or non-volatile memory or non-alterable, or fixed, memory. The alterable memory, whether volatile or non-volatile, can be implemented by using any one or more of static or dynamic RAM, a floppy disk and disk drive, a writeable or rewriteable optical disk and disk drive, a hard drive, flash memory or the like. Similarly, the non-alterable or fixed memory can be implemented using any one or more of ROM, PROM, EPROM, EEPROM, and gaps in optical ROM disk, such as a CD ROM or DVD ROM disk and disk drive, or the like.

The modular finishing assembly 16, 30 has many advantages. One is that modules can be mixed and matched to provide customized finishing functions for a particular customer. Another advantage is that as an additional finishing function is created, a new interchangeable module can be readily designed and added to the assembly. Some or all of the preexisting modules can remain unchanged. Another advantage is that multiple stackers can be added without the added cost incurred to provide the other functions such as compiling. Because the modules can now have a smaller number of functions, new modules for providing new finishing operations are easier to design. Field repairs are simplified by allowing the modules to be removable and easily replaced as a unit.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A finishing assembly which receives marked sheets of print media from an associated marking engine comprising:

a plurality of finishing modules, each of which performs a finishing function on the marked sheets, comprising:

a compiler module which compiles marked sheets into a set of sheets;

at least one stacker module, downstream of the compiler module, which is configured for receiving compiled sets of the marked sheets compiled by the compiler module and stacking a plurality of the sets of sheets into a stack;

at least one sheet set processing module intermediate the compiler module and the stacker module which receives a compiled set of marked sheets compiled by the compiler module and processes the compiled set of sheets; and a sheet set advancement assembly which advances sets of sheets along a substantially horizontal paper path between said compiler module and said at least one sheet processing module and between the at least one sheet processing module and the stacker module, the sheets of a set being stacked on top of one another, the finishing assembly being configured such that a first of the finishing modules performs a first finishing operation on a first set of marked sheets and a second of the finishing modules performs a finishing operation on a second set of marked sheets contemporaneously therewith.

2. The finishing assembly of claim 1, wherein the at least one stacker module comprises a plurality of stacker modules.

3. The finishing assembly of claim 1, wherein at least one of the at least one stacker modules comprises a release mechanism for selectively releasing a sheet set onto a stacker tray of the stacker module.

4. The finishing assembly of claim 3, wherein the release mechanism is configured for permitting sets of sheets to be advanced to a downstream stacker module.

5. The finishing assembly of claim 1, wherein the finishing assembly sequentially applies at least first and second post-marking finishing operations to the marked sheets, the first and second finishing operations being performed contemporaneously on respective sets of the marked sheets whereby a first of the sheet sets is undergoing a first finishing operation in the compiler while a second set of the marked sheets is undergoing a second finishing operation in a downstream processing module and in which the first set of marked sheets which has undergone the first finishing operation is advanced in a horizontal direction contemporaneously with the advancement of a second set of marked sheets which has undergone the second finishing operation.

6. The finishing assembly of claim 1, wherein at least one of the at least one sheet set processing modules is selected from the group consisting of a stapling module, a binding module, a stitching module, a hole punching module, and combinations thereof.

7. A printer comprising:

the finishing assembly of claim 1; and a marking engine which supplies marked sheets to the finishing assembly.

8. A method of finishing previously marked sheets with the finishing assembly of claim 1, comprising:

performing a first finishing operation on a first set of sheets in a first finishing module, the first finishing module comprising the compiler module;

performing a second finishing operation on a second set of sheets in a second finishing module contemporaneously with the first finishing operation;

thereafter, advancing the first set of sheets from the first finishing module to a first downstream finishing module;

contemporaneously with advancing the first set of sheets, advancing the second set of sheets from the second finishing module to a second downstream finishing module.

9. The method of claim 8, wherein the first finishing operation includes compiling the first set of sheets.

10. The method of claim 9, wherein the second finishing operation includes at least one of stapling, binding, stitching, and hole punching a previously compiled set of sheets.

11. The method of claim 8, wherein the first downstream module is the second finishing module.

12. The method of claim 8, wherein the advancing includes advancing the first and second sheets horizontally.

* * * * *